US007020916B1

(12) United States Patent
Agre et al.

(10) Patent No.: US 7,020,916 B1
(45) Date of Patent: Apr. 4, 2006

(54) CRIB AND TODDLER BED ELEVATION DEVICE

(75) Inventors: Mark F. Agre, Overland Park, KS (US); Susan J. Agre, Overland Park, KS (US)

(73) Assignee: Clever Works, LLC, Overland Park, KS (US)

( * ) Notice: Subject to any disclaimer, the term of this patent is extended or adjusted under 35 U.S.C. 154(b) by 0 days.

(21) Appl. No.: 10/963,175

(22) Filed: Oct. 12, 2004

(51) Int. Cl.
*A47C 21/00* (2006.01)

(52) U.S. Cl. ..... 5/509.1; 5/660; 248/188.2

(58) Field of Classification Search ..... 5/660, 5/509.1, 11, 658; 248/188.2
See application file for complete search history.

(56) References Cited

U.S. PATENT DOCUMENTS 2,072,791 A * 3/1937 Baer ..... 248/407
2,893,164 A 7/1959 Martin
2,933,850 A 4/1960 Martin
4,830,320 A * 5/1989 Bellows ..... 248/188.2
5,208,925 A 5/1993 Edlund
5,224,227 A 7/1993 McGinley
5,345,631 A 9/1994 Saperstein
5,924,661 A * 7/1999 Chernack ..... 248/188.2
6,012,185 A 1/2000 Woods
6,378,151 B1 4/2002 Lowe
6,575,414 B1 6/2003 Cuzzocrea
2001/0023509 A1 9/2001 Becker

* cited by examiner

*Primary Examiner*—Michael Trettel
(74) *Attorney, Agent, or Firm*—Cash Klemchuk Powers Taylor LLP; Darin M. Klemchuk

(57) ABSTRACT

A crib and toddler elevation device having selectively adjustable height and tilt angle is described. The elevator includes a base for placing on the floor and for receiving the legs of the crib or toddler bed. The elevator also includes a variety of mechanisms for adjusting the height of the crib or toddler bed, including elevating blocks. The elevator may also include an optional centerpiece to facilitate installation of the crib or toddler legs into the elevator.

13 Claims, 7 Drawing Sheets

CRIB AND TODDLER BED ELEVATION DEVICE

BACKGROUND

The present invention relates generally to crib and toddler bed elevators and in particular to an elevator capable of being variably adjusted and further capable of securely elevating various types of cribs and toddler beds.

Physicians and in particular pediatricians advise parents on occasion to elevate the head of their child's crib or toddler bed to alleviate conditions such as gastro-esophageal reflux, colds, and sinusitis. Elevating the head of the crib or toddler bed introduces a tilt to the sleeping surface, which has beneficial physiologic effects. For example, a baby suffering from acid reflux may obtain relief from tilting of his crib, which allows gravity to keep stomach acid from moving up into the baby's esophagus. Elevation also assists children suffering from earaches, head congestion, sore throats, and sinusitis by elevating the head above the body, and thereby enhancing drainage of the sinuses.

Depending upon the condition suffered by the child and its degree, a physician may direct the parents to tilt the bed at varying angles or he may direct the parents to tilt the bed at an initial angle and then adjust the tilt angle later to suit the child's conditions. Thus, a need exists for a crib and toddler bed elevator that is selectively and variably adjustable. Because the elevator is used around small children and toddlers, a need also exists for an elevator that includes safety features in the event a small child or toddler falls onto or strikes the elevator.

Adult bed elevators are common in the art. Examples of adult bed elevators include U.S. Pat. Nos. 2,893,164; 2,933,850; 5,224,227; 5,345,631; 6,012,185; 6,575,414 B2; and U.S. patent application Ser. No. 09/777,517 (Pub. No. U.S. 2001/0023509 A1). However, none of these patents provide a selectively adjustable system specifically designed for cribs or toddler beds. Due to size differences between cribs and adult beds and other design considerations, including safety, adult bed elevators are not generally suitable for cribs and toddler beds. For example, many of the adult bed elevators are made of hard material and have straight edges, which pose a risk to small children and toddlers. Adult bed elevators known in the art, typically comprised of two blocks, also do not provide a means for a user to quickly and easily install both elevator blocks nearly simultaneously. This feature is desirable because a parent will often wish to install a crib/toddler bed elevator while holding a child. A need exists, therefore, for an elevator specifically adapted for cribs and toddler beds.

Devices that elevate the mattress, as opposed to the legs, of a crib are also known in the art. U.S. Pat. Nos. 5,208,925 and 6,378,151 are examples. These patents do not adequately address the above problems because, among other things, both require a parent to expend considerable effort installing and removing the elevation devices. This would be difficult, if not impossible, to do while holding a small child. In addition, it is preferable that a mattress should be tight against all crib and toddler bed wall sides. Thus, there is a need to raise and lower the bed, rather than the mattress.

The present invention overcomes the limitations of the prior art devices and provides a safe, simple, and easy to install means for elevating a crib or toddler bed to assist a baby suffering from acid reflux, sinusitis, allergies, head congestion, or other conditions.

All references cited herein are incorporated by reference to the maximum extent allowable by law. To the extent a reference may not be fully incorporated herein, it is incorporated by reference for background purposes and indicative of the knowledge of one of ordinary skill in the art.

SUMMARY

The present invention is directed to a system and apparatus that satisfies the above-identified needs. The apparatus of the present invention comprises one or more base blocks 20 having a bottom surface 80, an outer side 24, an inner side 26, upper surface 42, and a well 22 located on the upper surface of the outer and inner sides. The well 22 is a recessed area having side walls 38 and a bottom surface 36 and is adapted to accept a leg 204 of a crib or toddler bed 200. Once the leg 204 is inserted into the well 22, the crib or toddler bed 200 will be elevated to a suitable height and angle to induce the health and other benefits discussed above.

In another embodiment of the present invention, a centerpiece 60 is provided. Each end of the centerpiece 60 is secured to the inner side 26 of each base block 20, thereby making the elements substantially rigid. Once the elements are secured, a user can install both base blocks 20 nearly simultaneously by moving the centerpiece 60 to place the base blocks 20 beneath the legs 204 of the crib or toddler bed 200.

In another embodiment of the present invention, means for adjusting the elevation and angle of tilt of the crib or toddler bed 204 are provided. In one embodiment, variable elevation blocks 86 of varying heights are used to selectively elevate the base blocks 20 to predetermined heights in order to achieve a selected tilt angle 206. The variable elevation blocks 86 are placed beneath and secured to the lower surface 80 of the base blocks 20.

In another embodiment of the present invention, rounded edges for the exterior surfaces of the base blocks 20 and centerpiece 60, if used, are provided. Padding 32 for the exterior surfaces is also provided. The rounded edges and padding enhance the safety of the apparatus in the event a small child or toddler falls onto or strikes the apparatus.

In another embodiment of the present invention, a means for securing a variety of crib and toddler bed legs 204 is provided. Commercially available cribs and toddler beds 200 use a variety of leg shapes. In one embodiment, the well 22 includes a relatively narrow slot 28 and a ring 30 for accepting narrow legs or legs 204 that have rollers, coasters, or ball-shaped ends.

Other objects, features, and advantages of the present invention will become apparent with reference to the drawings and detailed description that follow.

DESCRIPTION

In the following detailed description of the preferred embodiments, reference is made to the accompanying drawings, which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
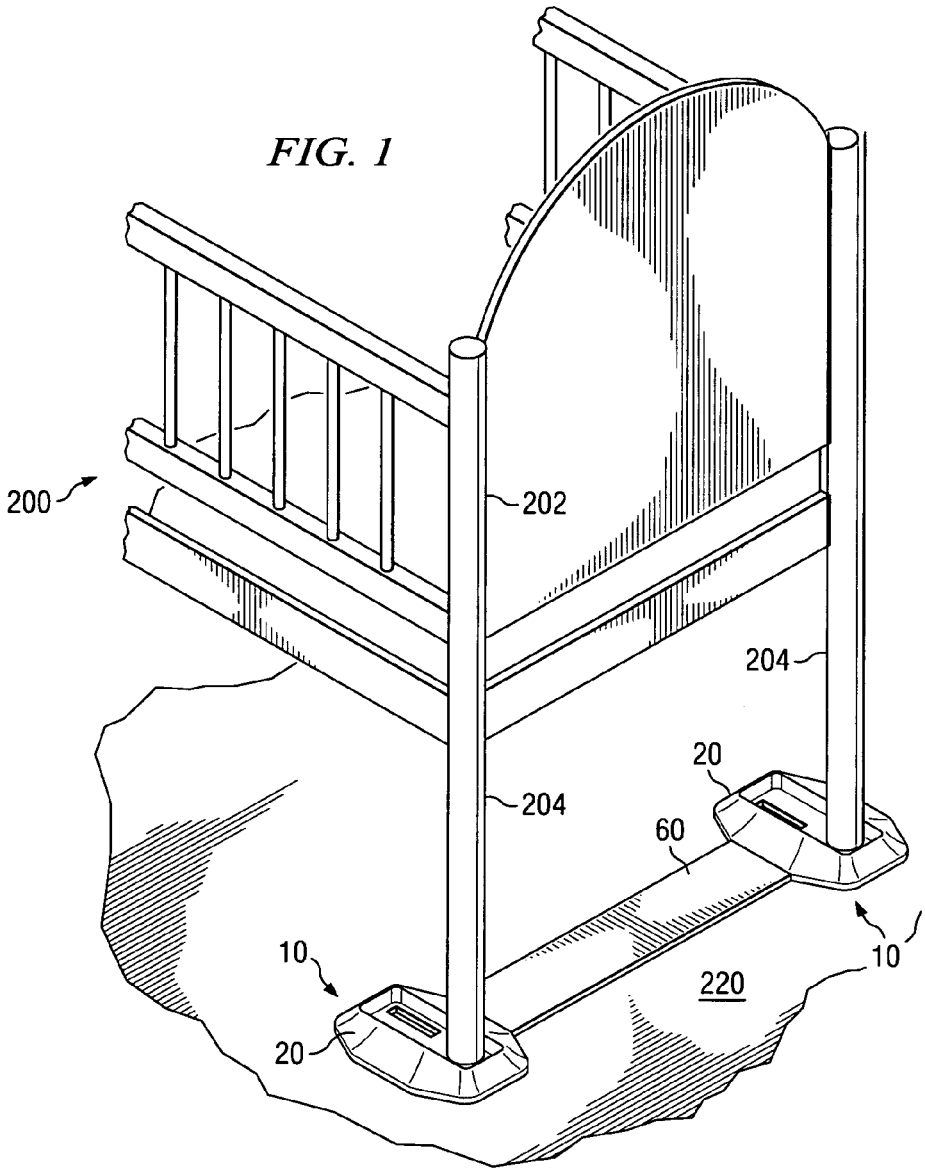
FIG. 1 is a perspective view of the present invention illustrating crib 200 installed on crib elevator 10.
Figure 2:
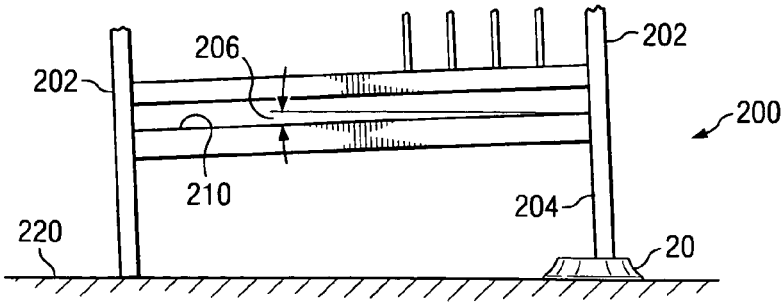
FIG. 2 is a side view of the present invention illustrating crib 200 installed on crib elevator 10 with a tilt angle 206.

The present invention is adapted to work equally well with cribs and toddler beds. For brevity, the description will use "crib" to mean both a crib and a toddler bed. Referring to FIG. 1, a crib 200 is illustrated installed into elevator 10. FIG. 2 illustrates a side view of the crib 200 and the elevator 10. As shown in the FIG. 1, one end of the crib 200 is elevated by elevator 10 resting on floor 220. The elevation of one end of the crib 200 creates a tilt angle 206 (shown in FIG. 2) relative to the horizontal. This tilt to sleeping surface 210 allows for the upper extremity of an infant or child to be higher than the child's abdomen and lower extremity or vice versa.

Figure 3:
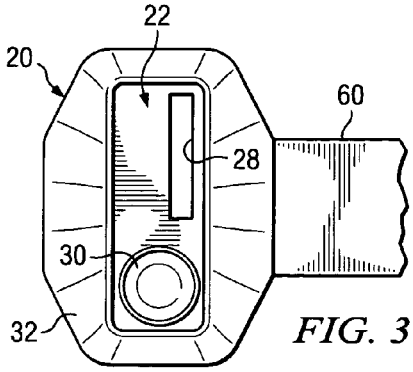
FIG. 3 is top view of the present invention illustrating base block 20 and centerpiece 60.
Figure 4:
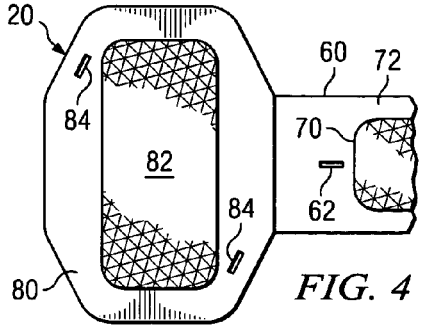
FIG. 4 is a bottom view of the present invention illustrating base block 20, optional non-slip surface 82, centerpiece 60, and optional non-slip surface 70.
Figure 5:
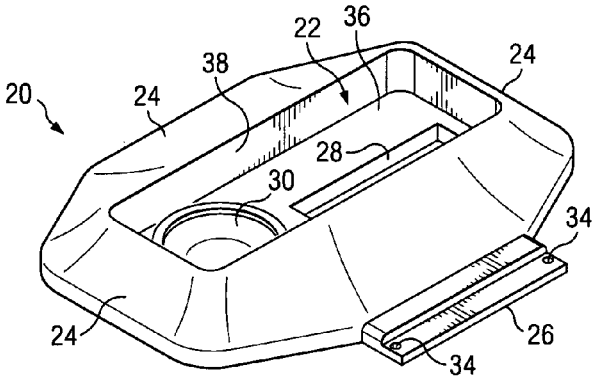
FIG. 5 is a perspective view of the present invention illustrating base block 20.

Elevator 10 includes the base blocks 20 and optional centerpiece 60. As shown in FIGS. 3, 4, and 5, the base block 20 has a bottom surface 80, upper surface 42, outer sides 24, inner side 26, and a well 22. A non-slip surface 82 such as rubber or the like material may optionally be added to the bottom surface 80 to further enhance the base block 20's ability to resist movement while the crib 200 is installed. In the preferred embodiment of the present invention, slots 84 are included on bottom surface 80 for securing the base block 20 to optional variable elevation block 86 (shown in FIG. 7). Typically, the base block 20 is 6 to 7 inches wide and 3 to 4 inches in height.

Turning to FIG. 5, well 22 of the base block 20 is illustrated. The well 22 is comprised of side walls 38 and bottom surface 36. The side walls 38 may be either sloped or substantially vertical. The well 22 is of sufficient depth and width to accommodate the leg 204 of the crib 200 and securely maintain it. Preferably, the bottom surface 36 of the well 22 is between ⅜ to ⅝ inches above the bottom surface 80 of base block 20. The bottom surface 36 of well 22 may be sloped to enhance performance of the base block 20 by increasing the area of contact between the bottom surface 36 and leg 204. FIG. 5 illustrates a rectangular-shaped well 22. The well 22 may be a round, oval, square, or other shape so long as it is capable of accommodating legs of common cribs and toddler beds. Cribs and toddler beds commonly use different legs structures, such as rectangular-shaped, cylindrical, and square-shaped legs of varying sizes. Coasters or rollers may also be used. Therefore, well 22 should be of sufficient width and depth to accommodate these varying sizes of legs. A well 22 depth of 1 to 2.5 inches and a width of 1 to 4 inches are preferred.

Figure 6:
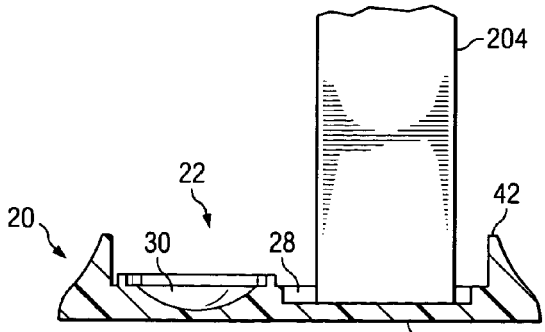
FIG. 6 is a side view of the present invention illustrating crib leg 204 installed in well 22 of base block 20.
Figure 7:
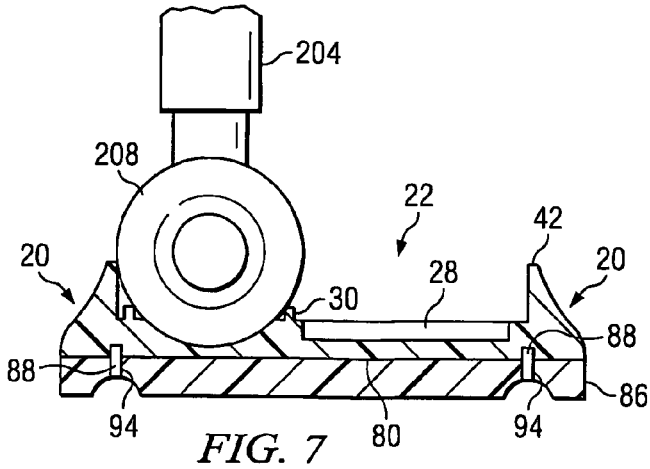
FIG. 7 is a side view of another embodiment of the present invention illustrating crib leg 204 with coaster or roller 208 installed in well 22 of base block 20.

The well 22 may also include a slot 28 and ring 30. Where the crib leg 200 is a relatively narrow rectangular shape, it can be inserted into slot 28 (shown in FIG. 6) located in the bottom surface 36 of the well 22. For a leg with a roller, coaster, or ball-shaped end, the leg can be installed as shown in FIG. 7 such that it rests on ring 30 on the bottom surface 36 of the well 22. Ring 30 will assist in restraining lateral movement of the roller, coaster, or ball within the well 22, and is preferably constructed of rubber or the like material. A relatively wide leg 204 without a roller, coaster, or ball is installed by inserting the leg 204 into the well 22 where it will rest primarily on the bottom surface 36. Thus, the various embodiments of the invention can accommodate a variety of leg shapes. One skilled in the art would appreciate the multitude of additional structures and manners in which crib and toddler legs can be secured in the base block 20.

The base block 20, including the bottom surface 36 and the inner walls 38 are preferably constructed of a rigid material such as plastic, hard rubber, wood, metal, and the like. A material that is economical to manufacture, durable in use, and refined in appearance is preferred. One skilled in the art would appreciate the different types of materials, which may be used. In the preferred embodiment, all exposed surfaces of the base block 20, including the edges of outer sides 24, the inner side 26, the well 22, the inner walls 38, and the bottom surface 80, should be substantially rounded. An edge of at least 1/16 of an inch in radius is preferred. Rounded edges are preferred over straight edges because they enhance the safety of the device and lessen the chance that a small child may be injured by falling onto or striking the base blocks 20. As shown in FIG. 3, padding 32 may optionally be attached over the exposed or exterior surfaces of the base block 20 to enhance the safety of the device. Padding 32 can also be attached to the optional centerpiece 60. Padding 32 can be made of cotton, synthetic material, rubber, foam, and any other suitable material. Preferably, outer sides 24 and inner side 26 slope downward from their respective intersections with the upper edge of well 22 to bottom surface 80 of the base block. These outer surfaces are preferably concave in shape and are a further enhancement of the safety of the device. Substantially straight surfaces and edges, however, may be used, but sloping surfaces and rounded edges are preferred as they enhance the safety of the device.

In the preferred embodiment, variable height adjustment blocks 86 (also referred to as variable elevation blocks) are used to allow a user to selectively adjust the height of the elevation and hence tilt angle 206. The blocks can be constructed of materials similar to the base block 20. In the preferred embodiment, all exposed edges of the variable elevation block 86 are substantially rounded similar to the base block 20. FIG. 7 illustrates a side view of a base block 20 with variable elevation block 86 installed. Variable elevation block 86 preferably includes studs or the like structure to secure it to bottom surface 80 of the base block 20. As shown in the figure, studs 88 protrude through slots 84 of the base block 20. This mechanism resists movement of the variable elevation block 86 relative to the base block 20. An optional non-slip surface 92 (not shown) is preferably disposed on bottom surface 90 of variable elevation block 86. Variable elevation block 86 may also include slots 94 similar to slots 84 of the base block 20 so that additional variable elevation blocks 86 may be used to further increase the height of the crib 200. The additional variable elevation blocks 86 may be secured in the same manner as the base block 20 is secured to variable elevation block 86.

Variable elevation blocks 86 of different heights may be used as well to vary the height of the crib 200. For example, blocks with a height of ½ an inch, 1 inch, 2 inches, and the like can be used alone or in combination to provide a variety of selectable heights. Variable elevation block 86 may either have a flat upper surface substantially parallel to its bottom surface or the upper surface may be sloped. The latter is preferred because it enhances the elevation of the crib 200 by increasing the surface area of contact between leg 204 and well 22.

To achieve the following angles with a common crib that is 54 inches in length, the following elevation heights are used:

| Elevation Height | Tilt Angle |
|---|---|
| .5" | .52 degree |
| 1" | 1.06 degrees |
| 2" | 2.12 degrees |
| 3" | 3.18 degrees |
| 4" | 4.25 degrees |

A tilt angle 206 of 1 to 4.5 degrees is preferred. One skilled in the art, however, will recognize that lesser or greater angles can be used depending upon the purposes for which the elevator 10 is used.

Because adult beds are considerably longer than the average crib or toddler bed, adult bed elevators known in the art will not produce the same or similar desired results. For example, a three-inch bed elevator used on an adult bed 82 inches in length will create an approximate 2.1-degree tilt angle. This is considerably less than the approximate 3.2-degree angle produced by the present invention for a crib 54 inches in length. For most applications, an elevation of 1.5 to 3 inches is optimal for a crib 54 inches in length.

Figure 11:
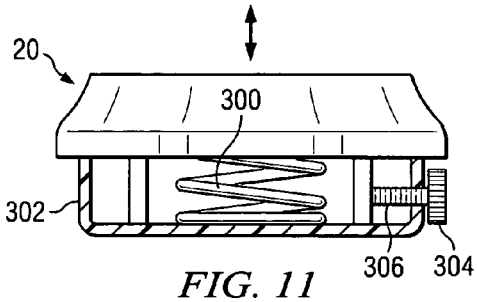
FIG. 11 is a side view of an alternative embodiment of the present invention illustrating an alternative height-adjustment means employing a spring 300.

In addition to variable elevation blocks 86, several other mechanisms and means can be used to selectively and variably adjust the height of the base blocks 20. FIG. 11 illustrates a mechanism comprised of a spring 300 located in a housing 302 and a knob 304 mounted on a screw 306. The height of the base block 20 can be adjusted by rotating the knob 304, which alters the force on the spring 300, thereby raising or lowering the base block 20. Alternatively, a large screw (not shown) can be used to adjust the height of the base block 20, which causes the block to move up or down depending on how the screw is turned.

Figure 12:
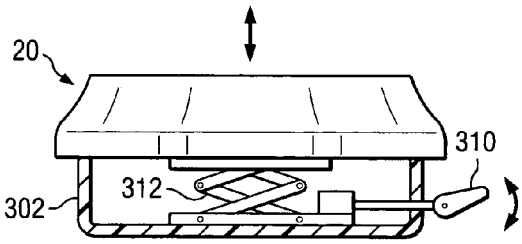
FIG. 12 is a side view of an alternative embodiment of the present invention illustrating an alternative height-adjustment means employing a lever 310.

In an alternative embodiment, a lever 310 mechanically coupled to a jack mechanism 312, similar to a jack for an automobile, is included with the base block 20. As shown in FIG. 12, the base block 20 may be raised by pressing on the lever 310 or lowered by raising up on the lever 310.

Figure 13:
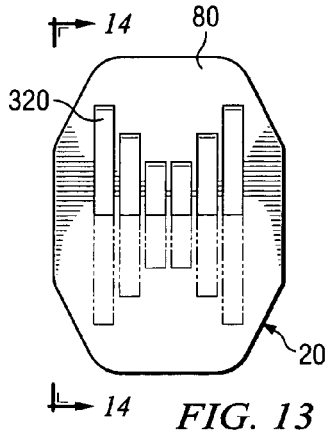
FIG. 13 is a bottom view of an alternative embodiment of the present invention illustrating an alternative height-adjustment means employing spring-loaded tabs 320.
Figure 14:
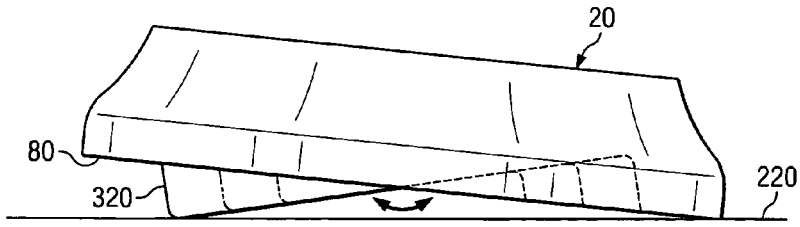
FIG. 14 is a side view of an alternative embodiment of the present invention illustrating an alternative height-adjustment means employing spring-loaded tabs 320.

In an alternative embodiment, shown in FIGS. 13 and 14, optional spring-loaded tabs 320 are installed in the bottom surface 80 of the base block 20. The elevation of the base block 20 can be adjusted by pressing on the spring-loaded tabs 320 and rotating them flush with the bottom surface 80 of the base block 20. The elevation of the base block 20 can be variably selected by depressing spring-loaded tabs 310 of different thicknesses. While FIG. 13 illustrates three sets of tabs of varying thicknesses, any number of tabs can be used to provide a maximum number of elevation options.

Figure 15:
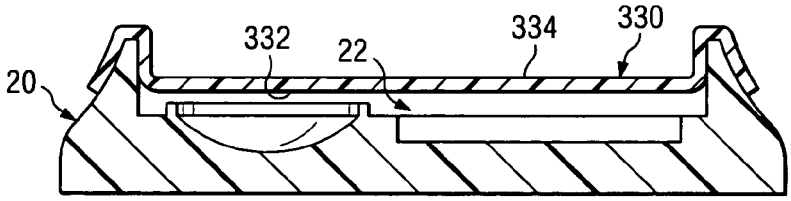
FIG. 15 is a side view of an alternative embodiment of the present invention illustrating an alternative height-adjustment means employing an insert 330.

In an alternative embodiment, shown in FIG. 15, an insert 330 is installed in the well 22 of the base block 20. The distance between the bottom surface 332 of the insert and its upper surface 334 is less than the depth of the well 22 of the base block 20. By installing the insert, the user can increase the elevation of the crib and hence the tilt angle. One skilled in the art will appreciate that inserts 330 of varying depths may be used to provide a variety of elevation height options to the user and that the inserts 330 can be flat or include additional structure similar to ring 30.

Figure 16:
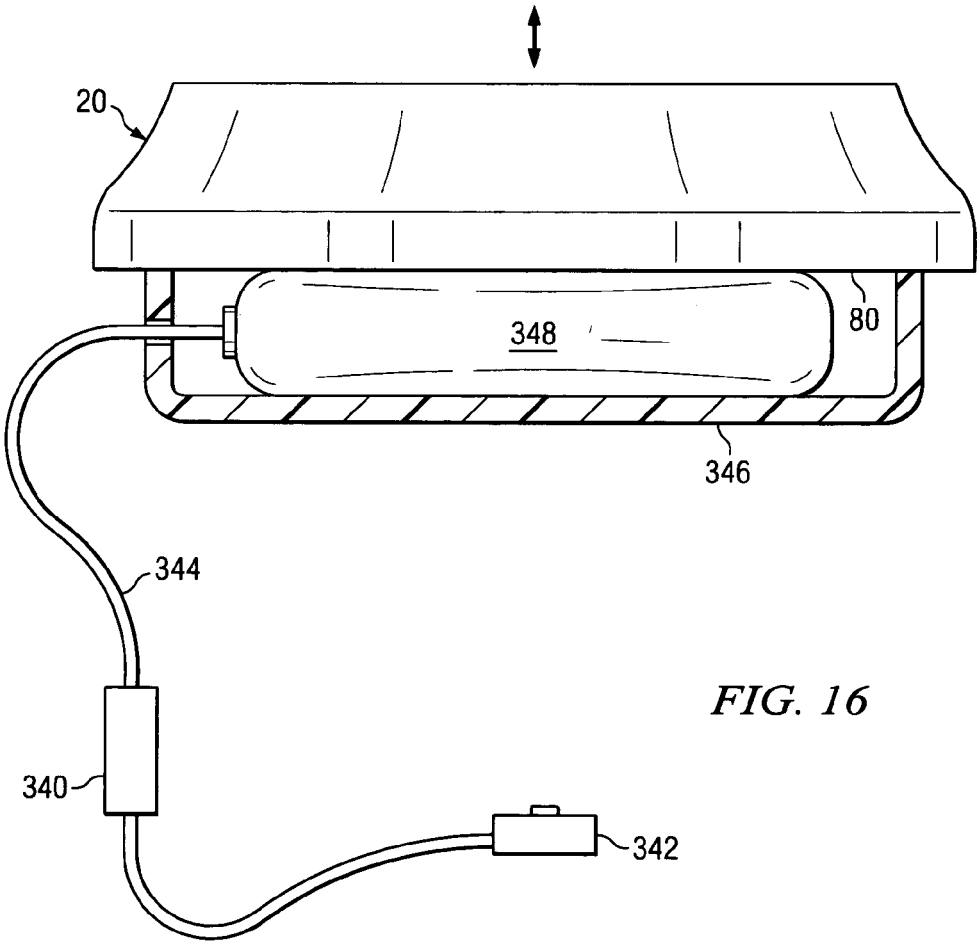
FIG. 16 is a side view of an alternative embodiment of the present invention illustrating an alternative height-adjustment means employing an air cartridge 340.

In an alternative embodiment, shown in FIG. 16, an air cartridge 340 is used to variably increase or decrease elevation. One end of the air cartridge 340 is connected to a switch mechanism 342, which allows a user to select increased elevation or decreased elevation. The air cartridge 340 is also connected to tubing 344, which is inserted into housing 346. As shown in FIG. 16, the housing 346 holds the modified base block 20 and allows the base block 20 to move vertically about the housing 346 as the air pressure in the housing is increased or decreased. Alternatively, an air bladder 348 can be installed in the housing 346 and connected to the tubing 344. As the pressure in the air bladder 348 expands, it causes the air bladder 348 to impinge upon the base block 20, thereby pushing it upward. Instead of a switch, a button may be used to actuate the air cartridge 340.

Figure 17:
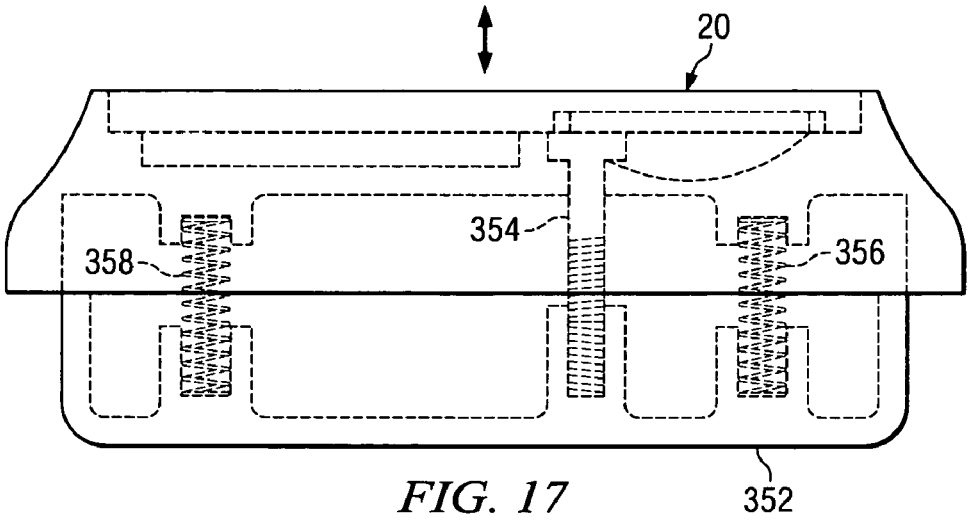
FIG. 17 is a side view of an alternative embodiment of the present invention illustrating an alternative height-adjustment means employing an adjustment screw 354 and springs 356 and 358.

In an alternative embodiment, shown in FIG. 17, an adjustment screw 354 is used to vary the height of base block 20. Springs 352 and 358, secured to housing 352, press upward on base block 20. Adjustment screw 354 raises or lowers the base block 20 by increasing or decreasing the compression of the springs 356 and 358.

Figure 18:
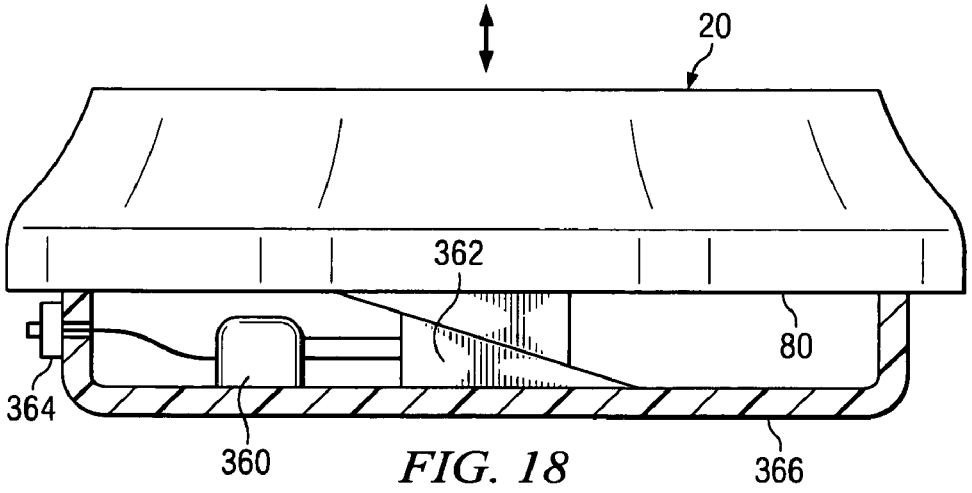
FIG. 18 is a side view of an alternative embodiment of the present invention illustrating an alternative height-adjustment means employing a motor 360.

In an alternative embodiment, shown in FIG. 18, a motor 360 is coupled with gear mechanism 362, which in turn is mechanically coupled with base block 20. A switch 364 is also coupled with the motor 360 so that a user can selectively adjust the elevation. If the user desires increased elevation, the motor 360 is actuated via the switch 364 and drives the base block 20 upward about the housing 366. Likewise, the user can selectively decrease the elevation via the switch 364, which actuates the motor 360 in the opposite direction, thereby lowering the base block 20.

Figure 19:
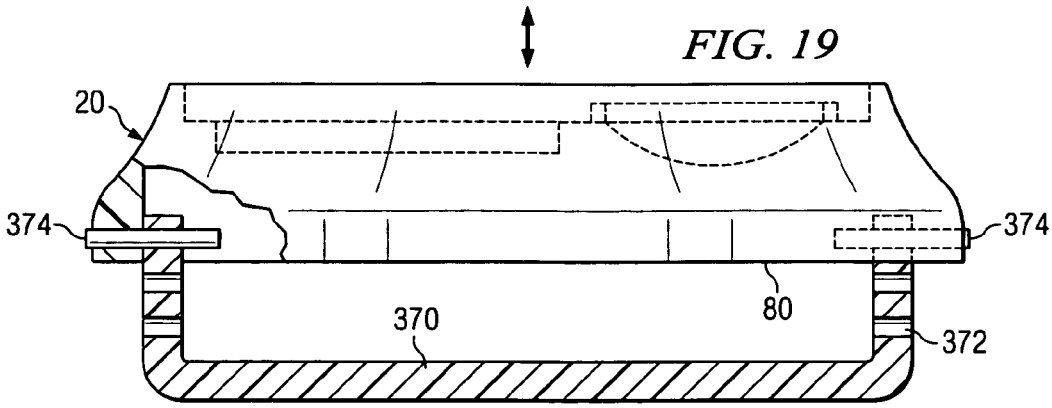
FIG. 19 is a side view of an alternative embodiment of the present invention illustrating an alternative height-adjustment means employing spring-loaded pins 374.

FIG. 19 illustrates another embodiment of the present invention. The base block 20 is inserted over housing 370, which contains at least one track (preferably two) of holes or notches 372. Spring-loaded pins 374 in base block 20, when in the actuated position, mechanically engage the holes 372 in the housing 370, thereby holding the base block 20 firmly within the housing 370. A user can adjust the elevation up or down by pulling on the spring-loaded pins and moving the base block 20 upward or downward. Once the appropriate elevation is selected, the pins 374 are released, thereby engaging with the holes 372 in the housing 370 to secure the base block 20.

Figure 20:
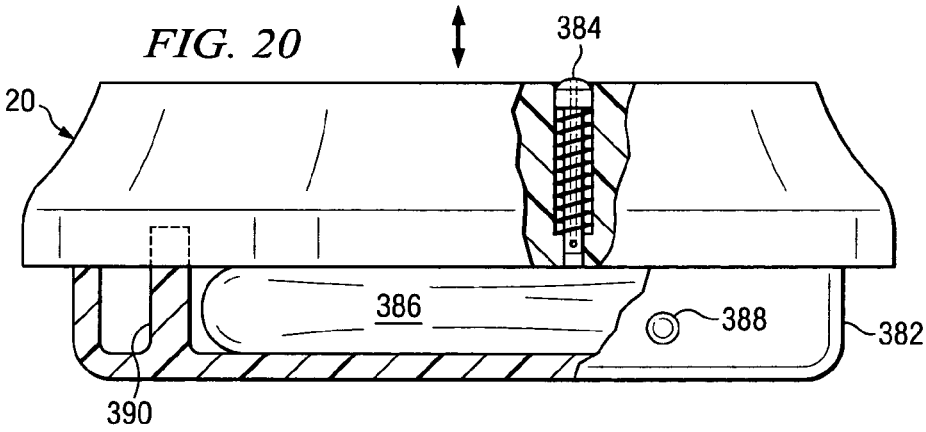
FIG. 20 is a side view of an alternative embodiment of the present invention illustrating an alternative height-adjustment means employing an air control valve 384.

In an alternative embodiment, shown in FIG. 20, base block 20 rests on housing 382, which includes an air-control valve 384, air chamber or bladder 386, air discharge means 388, and optional support member 390. The base block 20 may be raised by the user depressing air-control valve 384, which increases the air in the air chamber or bladder 386. As the pressure in air chamber or bladder 386 increases, it impinges upon the bottom surface of the base block 20, thereby pushing it upward. The base block 20 can be lowered by depressing the air discharge means (similar to a piston of an ordinary bicycle tire inner tube) to evacuate the air and thereby decrease the upward pressure on the base block 20.

Figure 21:
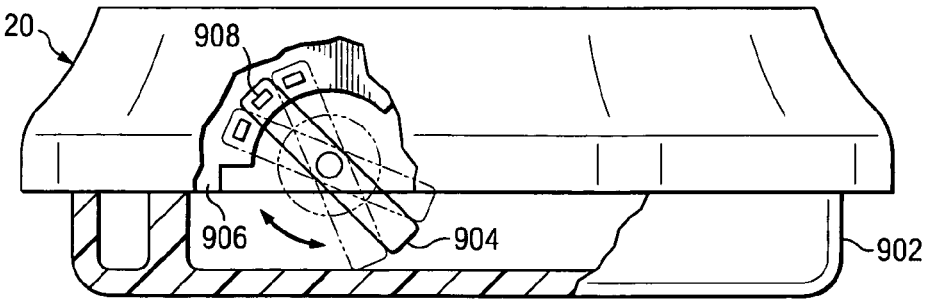
FIG. 21 is a side view of an alternative embodiment of the present invention illustrating an alternative height-adjustment means employing a lever 904.

In an alternative embodiment, shown in FIG. 21, base block 20 is supported on support block 902 and may be raised by a lever mechanism similar to the means commonly used to raise and lower wheels of lawn mowers. The base block 20 includes a surface 906 with teeth 908 attached to it at varying heights. As illustrated in FIG. 21, lever 904 includes a slot matching the teeth 908 of the base block 900 and can be rotated to be secured to the various teeth 908. The height of the base block 20 is adjusted be altering the position of the lever 904.

In another embedment of the present invention, shown in FIG. 1, an optional centerpiece 60 is connected to the base blocks 20 so that all three elements form a substantially rigid structure. This allows for the installation of both legs 204 of the crib 200 into the base blocks 20 nearly simultaneously. Without centerpiece 60, legs 204 of the crib 200 must either be installed one after another or both the base blocks 20 must be placed independently in the appropriate position next to legs 204 prior to installation. The embodiment with a centerpiece 60 presents an advantage to the user, particularly a parent holding a small child, in that the user can install elevator 10 by lifting the crib 200 only once and using a foot to position the base blocks 20 appropriately.

Figure 9:
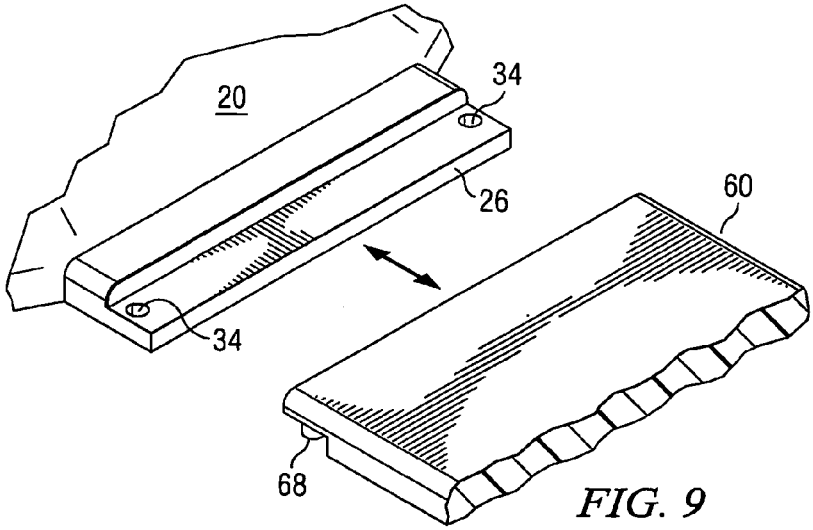
FIG. 9 is a side view of an embodiment of the present invention illustrating centerpiece 60 and base block 20.

Turning to FIG. 4, the bottom surface 72 of the centerpiece 60 is shown. The centerpiece 60 may optionally include a non-slip surface 70 and slots 62 (only one shown) for securing to variable elevation blocks 86. FIG. 9 illustrates a side view of the centerpiece 60 secured to the base block 20. As shown in the figure, the centerpiece 60 in this embodiment has notches or studs 68, which protrude through slots 34 in the base block 20, thereby securing the centerpiece 60 over the base block 20. In the preferred embodiment, the ends of the centerpiece 60 are substantially rounded to avoid creating a straight edge where the centerpiece 60 is secured to the base blocks 20.

Alternatively, the centerpiece 60 may be attached to the base blocks 20 by fasteners, latches, or clips. In another embodiment, the width of the centerpiece 60 is slightly larger than inner side 26 of the base block 20 so that the centerpiece 60 fits snugly over the base block 20. Other embodiments include the use of a hinge and pin mechanism similar to a common door hinge and the inclusion of grooves, slots, or notches in the base block 20 to which the centerpiece 60 fits snugly. An apparatus similar to a door handle may also be used. One skilled in the art will appreciate a multitude of different mechanisms and manners in which the centerpiece 60 can be secured to the base blocks 20. The precise manner in which the centerpiece 60 is secured to the base blocks 20 is not material to the invention so long as they can be moved substantially simultaneously by pushing on the centerpiece 60.

Figure 8:
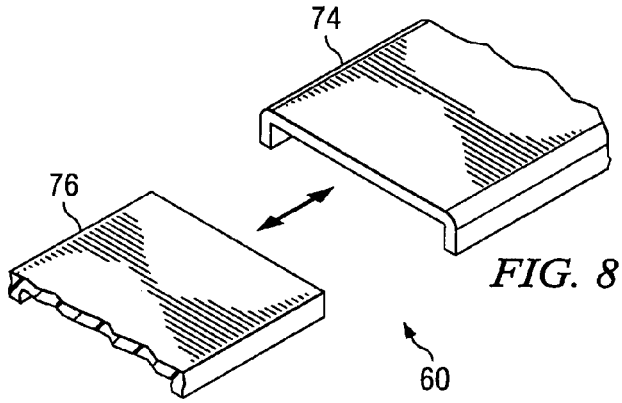
FIG. 8 is a perspective view of the present invention illustrating centerpiece 60 comprised of an outer sleeve 74 and inner sleeve 76.

The centerpiece 60 may be a fixed predetermined length such as to accommodate a crib 30-inches in width or it may be adjustable to accommodate a variety of crib widths. In the preferred embodiment, the length of the centerpiece 60 is adjustable and includes two sleeves. FIG. 8 illustrates this embodiment, which includes one sleeve 74 that is slightly larger than the other sleeve 76 so that the narrower sleeve 76 can slide axially about the wider sleeve 74. The length of the centerpiece 60 can be adjusted by pulling or pushing the sleeves together.

Figure 10:
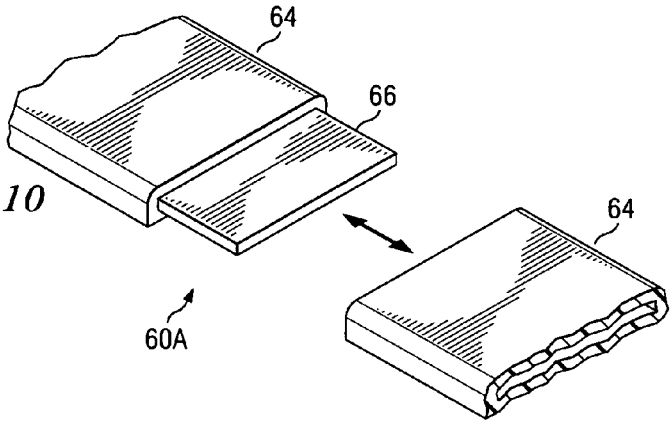
FIG. 10 is a perspective view of an alternative embodiment of the present invention illustrating outer sleeve 64 and inner shaft 66 of centerpiece 60A.

In another embodiment, as shown in FIG. 10, the alternative centerpiece 60A includes outer sleeves 64 and inner shaft 66, to allow the length of centerpiece 60A to be adjusted. Outer sleeves 64 are slidably secured about inner shaft 66 such that the length of the centerpiece 60 may be adjusted by sliding the outer sleeves axially about inner shaft 66. Other manners in which the centerpiece 60's length may be adjusted are through the use of a series of blocks that interlock together allowing the user to selectively modify the length by choosing an appropriate number of blocks; two or more interlocking sleeves that may be contracted or expanded axially (telescopically) by exerting force on the ends of the centerpiece 60; and a honeycomb style centerpiece 60 that has the ability to flex to a desired length. One skilled in the art would appreciate the multitude of different mechanisms and manners through which the width of the centerpiece 60 may be adjusted.

The preferred embodiment of the present invention can be used according to the following steps. First, the user determines the appropriate tilt angle desired and the corresponding elevation height. The user then determines whether the base block 20 will provide the desired elevation height or whether one or more variable elevation blocks 86 are to be used alone or in combination with the base block 20. Second, the user lifts the end of the crib to be elevated. Third, the user places the base blocks 20 beneath the legs 204 of the crib to be elevated. If the preferred embodiment is used, the user may place both base blocks 20 simultaneously by aligning the centerpiece 60 to the appropriate location. If an embodiment of the invention is used without a centerpiece, the user will initially place the base block 20 next to one of the crib legs 204 and lower the crib, while pushing the base block 20 into place. The user then lifts the crib a second time to install the second base block 20. Fourth, the user should ensure that the crib legs 204 are securely installed in the wells 22 of the base block 20 by shaking the crib or otherwise verifying its stability. The height of the crib elevation can later be adjusted by the means discussed above, including adding or removing the variable elevation blocks 86 from the base blocks 20.

The primary advantage of the present invention is that it provides a system and apparatus for reliably and securely elevating a crib or toddler bed. Another advantage of the present invention is that it provides a means by which the elevation height and tilt angle can be variably selected according to the user's desire. Other advantages of the present invention include, the use of rounded edges and padding to enhance the safety of the elevator for use around small children and toddlers. Yet another advantage is that both base blocks 20 can be installed substantially simultaneously through use of a centerpiece 60 secured at each end to a base block 20. This eliminates the need to install each base block 20 separately, which may require the user to lift the crib more than once.

It should be apparent from the foregoing that an invention having significant advantages has been provided. While the invention is shown in only a few of its forms, it is not just limited, but is susceptible to various changes and modifications without departing from the spirit thereof.

We claim:

1. A system for elevating the height of a crib or toddler bed having legs and resting on a surface, the system comprising:

two base blocks, each base block having a bottom surface, an inner side, an upper surface, and a well, having side walls and a bottom surface, formed within the upper surface for accepting the leg of the crib or toddler bed; and a centerpiece having two ends, each end connected to the inner side of one of the base blocks.

2. The system of claim 1, wherein the centerpiece includes a means for variably adjusting the length of the centerpiece.

3. The system of claim 2, wherein the means for variably adjusting the length of the centerpiece includes a centerpiece comprised of an inner sleeve and outer sleeve, the inner sleeve adapted to fit within the outer sleeve and capable of being slid along the axis of the outer sleeve to variably adjust the length of the centerpiece.

4. The system of claim 1 additionally including a means for variably adjusting the elevation of the crib or toddler bed.

5. The system of claim 4, wherein the means for variably adjusting the elevation of the crib or toddler bed is comprised of two or more height adjustment blocks, each height adjustment block adapted to be placed between a base block and the surface to adjust the height of the crib or toddler bed to a selected level.

6. The system of claim 1, wherein the base block additionally includes a ring secured to the bottom surface of the well for accepting a roller, ball, or coaster of the crib or toddler bed leg.

7. The system of claim 1, wherein the base block additionally includes a slot formed in the bottom surface of the well for accepting the leg of a crib or toddler bed.

8. The system of claim 1, further including a means for variably adjusting the elevation of the crib or toddler bed and wherein the centerpiece includes a means for variably adjusting the length of the centerpiece.

9. The system of claim 1, wherein padding is disposed on the upper surface of the base blocks.

10. A system for elevating the height of a crib or toddler bed having legs and resting on a surface, the system comprising:

two base blocks, each base block having a bottom surface, an upper surface, an inner side, and a well, having side walls and a bottom surface, formed within the upper surface for accepting the leg of the crib or toddler bed, wherein the exposed edges of the base block are substantially rounded; and a centerpiece having two ends, each end connected to the inner side of one of the base blocks, and having exposed edges, wherein the exposed edges of the centerpiece are substantially rounded.

11. The system of claim 10 additionally including two or more height adjustment blocks, each height adjustment block adapted to be placed between one of the base blocks and the surface to adjust the height of the crib or toddler bed to a selected level.

12. The system of claim 10 additionally including padding disposed on the exposed surfaces of the base blocks and centerpiece.

13. The system of claim 10, wherein the centerpiece includes a means for variably adjusting the length of the centerpiece.

* * * * *